US007050012B2

(12) United States Patent
Chen

(10) Patent No.: US 7,050,012 B2
(45) Date of Patent: May 23, 2006

(54) ANTENNA AND ANTENNA ADJUSTMENT STRUCTURE

(75) Inventor: Shih-Hong Chen, Taipei Hsien (TW)

(73) Assignee: Wistron NeWeb Corporation, Hsi-Chih (TW)

( * ) Notice: Subject to any disclaimer, the term of this patent is extended or adjusted under 35 U.S.C. 154(b) by 40 days.

(21) Appl. No.: 10/709,818

(22) Filed: May 31, 2004

(65) Prior Publication Data

US 2005/0052335 A1 Mar. 10, 2005

(30) Foreign Application Priority Data

Sep. 10, 2003 (TW) ..... 92125065 A

(51) Int. Cl.
*H01Q 1/12* (2006.01)
*H01Q 3/02* (2006.01)

(52) U.S. Cl. ..... 343/757; 343/882

(58) Field of Classification Search ..... 343/757, 343/765, 880, 882
See application file for complete search history.

(56) References Cited

U.S. PATENT DOCUMENTS 4,628,323 A * 12/1986 Crean ..... 343/765
6,407,713 B1 * 6/2002 Mallenius ..... 343/765
6,762,731 B1 * 7/2004 Chou ..... 343/882

* cited by examiner

*Primary Examiner*—Michael C. Wimer
(74) *Attorney, Agent, or Firm*—Winston Hsu

(57) ABSTRACT

An antenna carrier includes a mast, a mast clamp installed at one end of the mast and rotatable with respect to the mast, and a fixture. The mast clamp has an extension arm. The fixture has a holder, a U-bolt, and a fine tune module with one end fixed to the extension arm. One end of the holder is moveably connected to the fine tune module. The U-bolt is moveably disposed in the holder for fixing the holder on one side of the mast.

13 Claims, 5 Drawing Sheets

ANTENNA AND ANTENNA ADJUSTMENT STRUCTURE

BACKGROUND OF INVENTION

1. Field of the Invention

The present invention relates to an antenna carrier, and more specifically, to an antenna carrier which allows precise adjustments of its orientation angle.

2. Description of the Prior Art

At the moment, the development of telecommunications is quite astonishing, and the market for telecommunication is maturing. With the development of satellite techniques and applications, more and more information is transmitted via satellites such as broadcast television and weather maps for example. Adjusting the antenna to receive the satellite signals is an important step when setting up a satellite antenna. When the satellite antenna is adjusted at the appropriate angle, it can receive satellite signals at optimum strength.

The receiving device or transmitting device of the traditional dish satellite antenna includes a dish reflector for receiving satellite signals and focusing the received signals and at least one low noise signal amplifier (LNBF) for receiving the reflected signals. In addition, for accurately receiving the signals, the longitude and latitude of the receiver and the angle between the receiver and the satellite should be checked. The rotation angle, dish elevation angle and dish orientation angle should be adjusted to make the antenna receive the satellite signals in different areas.

In the fixing process of the antenna, when the satellite signals are multi-beam, weak, or two way; or the directivity of the antenna signals need to be more sensitive (i.e. the antenna radiation lobes' beamwidth is narrower), there is no fine tune module to help the fixer adjust the rotation angle. As a result, the fixer wastes a lot of time and force to adjust the antenna angle. Even then, the antenna is still unable to accurately receive the satellite signals.

In addition, the Mast Dish antenna, used widely in the Europe and America, does not have a very rigid dish. As a result, the shape of the dish may be changed by forces exerted by the user when pushing the dish to adjust the orientation angle. Because the shape of the dish has changed, the reflecting characteristics of the dish will also be changed, resulting in the inability of the antenna to achieve optimal signal quality.

There are some current designs for the antenna carrier that adjust the elevation angle and the rotation angle. However, since sizes of dish antennas are becoming smaller, the accuracy of satellite aligning is becoming more important. Therefore, designs that only fine-tune the elevation angle and rotation angle are not adequate for the needs of satellite antenna fixing.

SUMMARY OF INVENTION

It is therefore a primary objective of the claimed invention to provide an antenna carrier which allows precise adjustments of its orientation angle to make the antenna exactly receive the signals.

According to the claimed invention, an antenna carrier comprises a mast, a mast clamp installed at one end of the mast and rotatable with respect to the mast, and a fixture. The fixture comprises a holder, a bolt, and a fine-tune module. One end of the fixture is fixed to a extension arm, one end of the holder moveably connected to the fine tune module, and the bolt moveably disposed in the holder for fixing the holder on one side of the mast.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
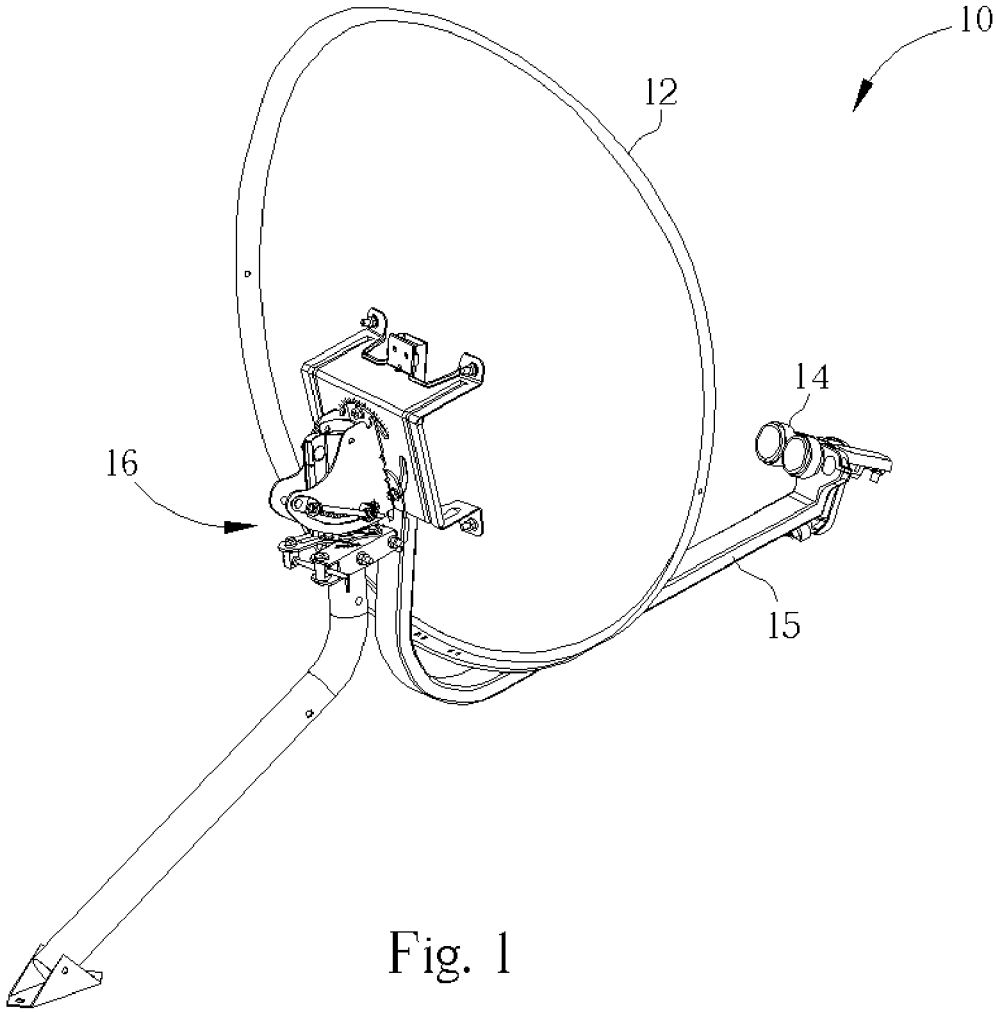
FIG. 1 is a perspective diagram of the antenna module with an antenna carrier of the invention.

Please refer to FIG. 1. A general dish-shaped antenna is used in the embodiment. The invention can also be used on other kinds of antennas with directivity. FIG. 1 is perspective diagram of the antenna module 10 with an antenna carrier of the invention. The antenna module 10 comprises an antenna 12 for reflecting received satellite signals and at least one low noise signal amplifier 14 set at the focus of the antenna for receiving the signals reflected by the antenna 12, and an antenna carrier 16 for carrying the antenna 12.

Figure 2:
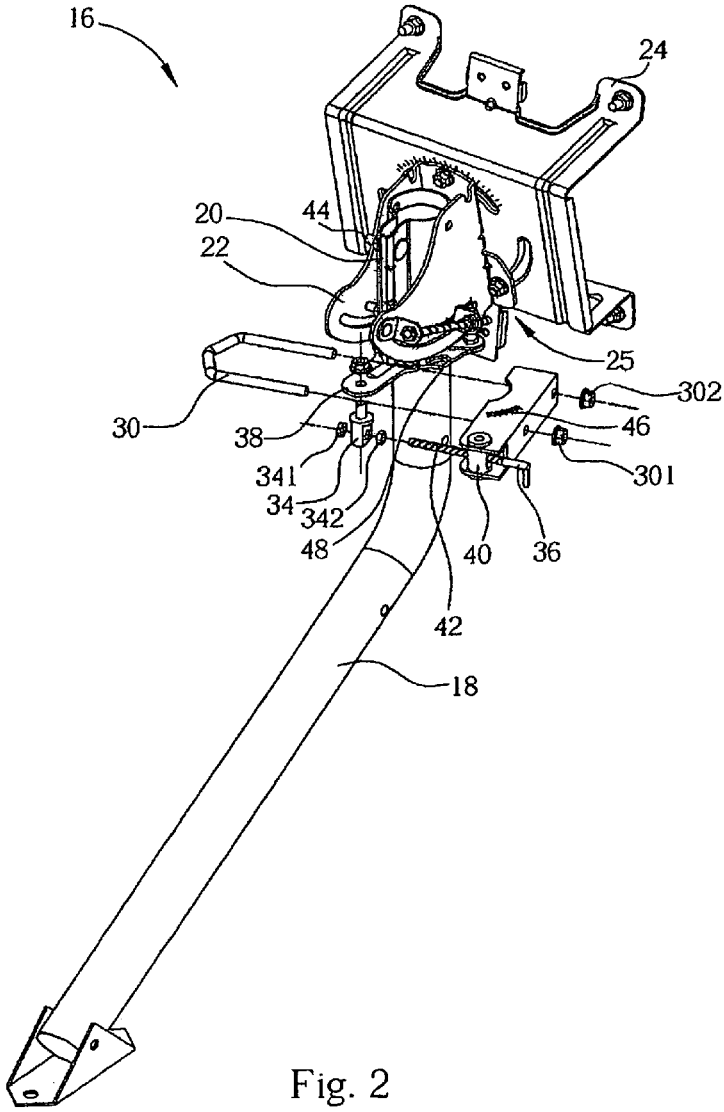
FIG. 2 is an exploded diagram of the antenna carrier in FIG. 1.
Figure 3:
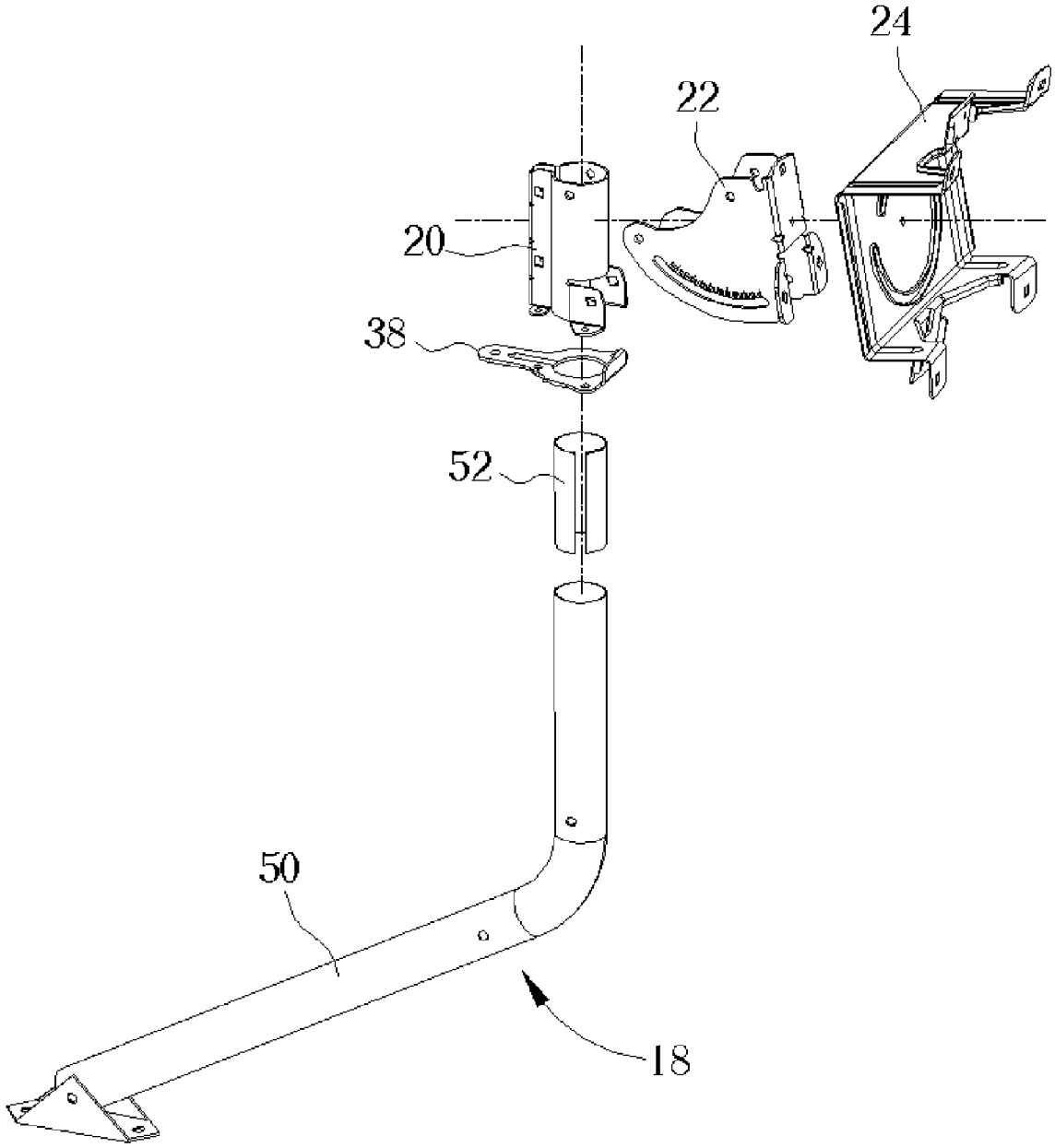
FIG. 3 is a simplified exploded diagram of an antenna carrier.

Please refer to FIG. 2 and FIG. 3. FIG. 2 is an exploded diagram of the antenna carrier 16 in FIG. 1. FIG. 3 is a simplified exploded diagram of antenna carrier 16.

The antenna carrier 16 comprises the following.

There is a support arm 15 with one end connected to the low noise signal amplifier (LNBF) 14 as shown in FIG. 1. There is a mast 18 comprising a support seat 50 and a bushing 52 with a mast clamp 20 installed at one end of the mast 18 and rotatable with respect to the mast 18 as shown in FIG. 3.

Connected to the mast clamp 20 are a fixture (shown but not labeled in FIG. 2) and a bracket 22. The fixture 26 installed on the mast clamp 20 is for fixing a fine tune module. The bracket 22 with the first end fixed on one end of the mast clamp 20 and the second end rotatablely fixed on the mast clamp 20 with respect to the mast clamp 20 is for adjusting the elevation angle of the antenna module 10.

Lastly, there is a rotational fixture 24 rotatablely fixed on the bracket 22 and connected to the support arm 15 for adjusting the antenna 12. The arc-shaped slot on the rotational fixture 24 combined with the three screw holes on the bracket 22 along with their corresponding screws form the dish elevation angle fine tune module 25.

Figure 4:
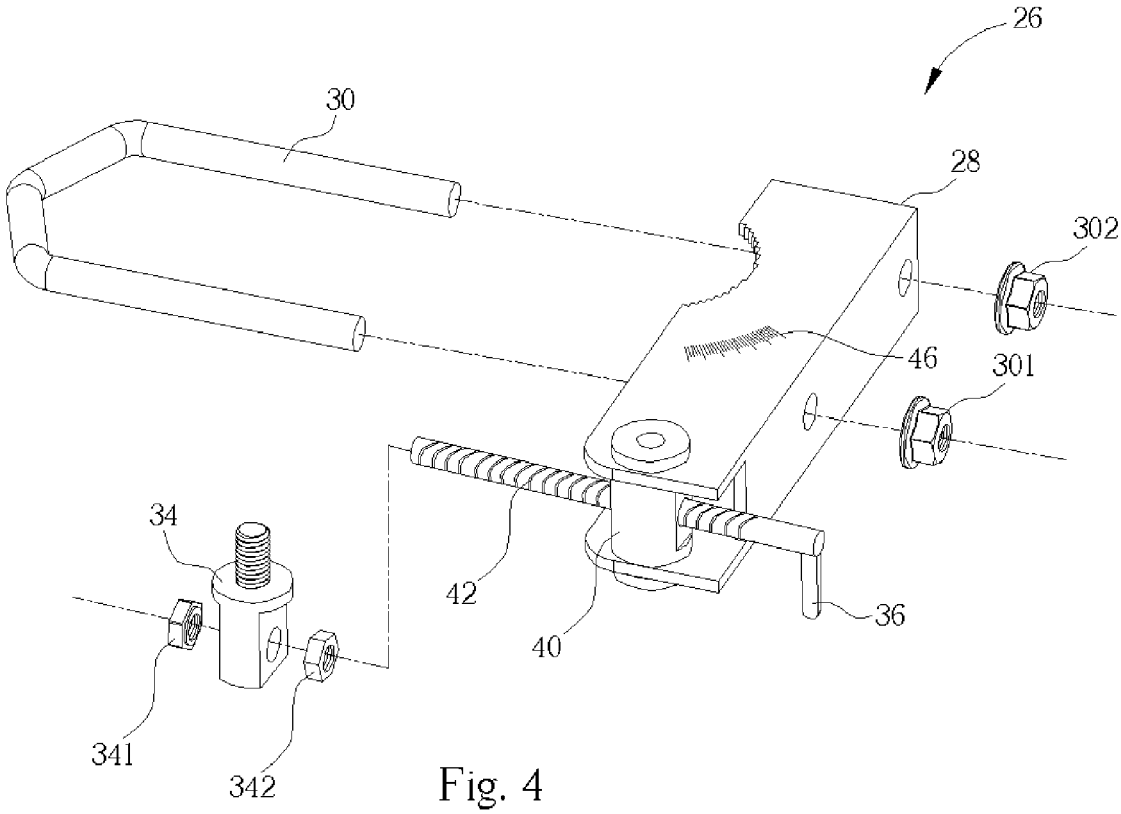
FIG. 4 is an exploded diagram of a fixture in the antenna carrier in FIG. 2.
Figure 5:
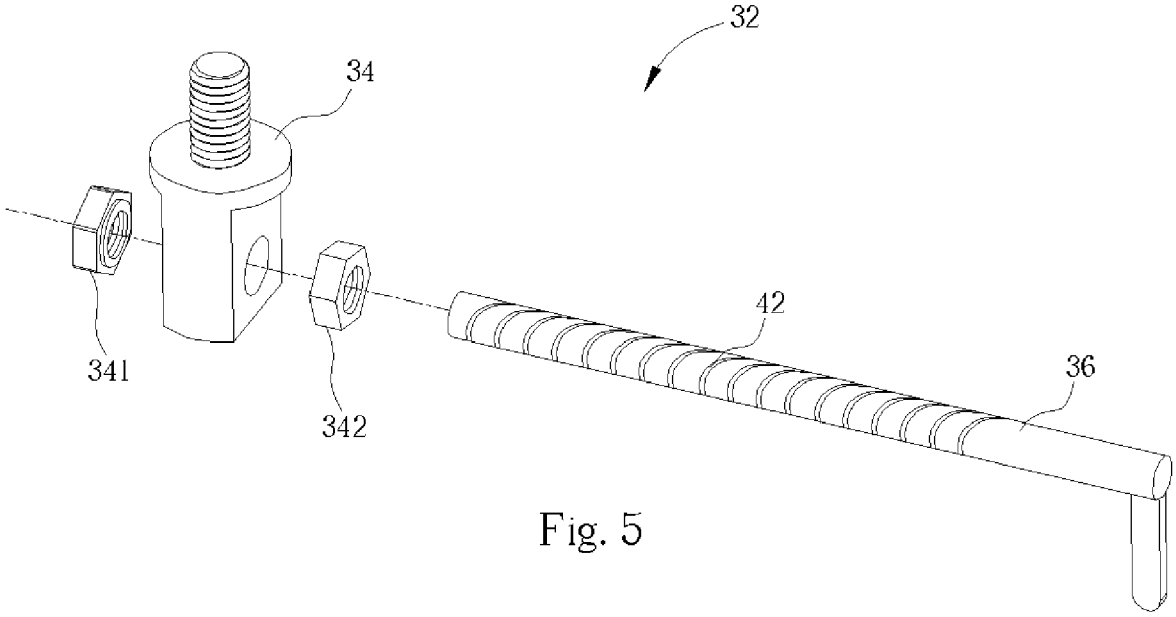
FIG. 5 is an exploded diagram of a fine-tuning module of the antenna carrier in FIG. 2.

Please refer to FIG. 4 and FIG. 5. FIG. 4 is an exploded diagram of the fixture 26 and the fine tune module 32 in the antenna carrier 16 in FIG. 2. FIG. 5 is an exploded diagram of the fine tune module 32 of the antenna carrier 16 in FIG. 2.

The fixture 26 of the antenna carrier 16 is not a single piece but comprises a holder 28 with a threaded bushing 40, a U-bolt 30, two nuts 301 and 302, and a fine tune module 32 (not labeled in FIG. 4). The fine tune module 32 is also not a single piece but comprises a studded bushing 34, a second nut 341, a third nut 342, and a screw rod 36 with a screw thread 42 portion.

Concerning the fine tune module 32, the studded bushing 34 comprises a hole that is occupied by the screw rod 36 and a threaded stud perpendicular to this hole. The hole of the studded bushing 34 is not threaded. Additionally, the diameter of the hole is slightly larger than the diameter of the screw rod 36. The nut 341 and the nut 342 are installed on opposite sides of the studded bushing 34 and fixed at one end of the screw rod 36.

When the screw rod 36 moves along the direction of the long axle, the studded bushing 34 is moved by either the nut 341 or the nut 342. As stated earlier, the hole of the studded bushing 34 is slightly larger than the screw rod 36, and as a result, when the screw rod is installed, the studded bushing 34 is not screwed onto the screw rod 36. However, the threaded bushing 40, rotatablely installed on the holder 28, is screwed onto the screw rod 36 because the hole of the threaded bushing 40 matches the diameter of the screw rod 36, and the inside of the hole is threaded to match the screw thread 42 of the screw rod 36. When the screw rod 36 is screwed and the threaded bushing 40 is fixed, the screw rod 36 is able to generate movement along the direction of the long axis.

Please refer to FIG. 2 and FIG. 4 again. The mast clamp 20 comprises an extension arm 38 installed on the underside of the mast clamp 20 (the extension arm 38 can be a extension part under the mast clamp 20 or a another component installed on the underside of the mast clamp 20) and at least a fixing module 44 for fixing the mast clamp 20 on one end of the mast 18. The fixture 26 has a fine tuning graduation 46, and the extension arm 38 of the mast clamp 20 has a first pointer 48 for pointing to a value of the rotation angle of the antenna on the fine tuning graduation 46.

For accurately receiving satellite signals, the rotation angle, the elevation angle, and the orientation angle must be properly adjusted. For adjusting the orientation angle, the antenna 12 should first be adjusted in a direction that is roughly aligned to receive the satellite signals. (The angle is usually not the optimal angle to receive the satellite signals). With the antenna roughly aligned in the direction of the satellite, the orientation angle can be fine-tuned.

At that moment, the nut 301 and the nut 302 are used for locking the bolt 30. As shown in FIG. 2, the fixture 26 is fixed on the mast 18. The studded bushing 34 is attached to the extension arm 38 and the fine tune module 32 is installed in the fixture 26. Then, the threaded bushing 40 is fixed on the mast 18 the screw rod 36 of the fine tune module 32 via the fixture 26 so that the screw rod 36 is generated a movement along the direction of the long axle.

As mentioned above, the studded bushing 34 is moved by either the nut 341 or the nut 342. The movement of the studded bushing 34 causes a chain reaction of movements via the extension arm 38, mast clamp 20, bracket 22, rotation fixture 24, and the antenna 12. When the antenna is adjusted to the optimal angle, the fixing components 44 on the side of the mast clamp 20 are locked which fixes the mast clamp 20 on the mast 18 which in turns fixes the antenna at the orientation angle that most accurately receives satellite signals.

Compared to the prior art, when the satellite signals are multi-beam, weak, in two way, or the directivity of the antenna signals need to be more sensitive, i.e. the antenna radiation lobes beamwidth is narrower, the antenna carrier 16 can allow the fixer to finely tune the orientation angle of the antenna 12 to the optimum angle at which the antenna receives the satellite signals.

Those skilled in the art will readily observe that numerous modifications and alterations of the device may be made while retaining the teachings of the invention. Accordingly, the above disclosure should be constructed as limited only by the metes and bounds of the appended claims.

What is claimed is:

1. An antenna carrier comprising:

a mast;

a mast clamp installed at one end of the mast rotatable with respect to the mast, said mast clamp comprising an extension arm; and a fixture comprising a holder, a bolt, and a fine tune module with one end fixed to the extension arm, one end of the holder moveably connected to the fine tune module, the bolt moveably disposed in the holder for fixing the holder on one side of the mast;

wherein the fine tune module comprises a studded bushing having a threaded stud rotatably disposed on the extension arm of the mast clamp, and a threaded rod having one end threaded into a threaded bushing; the studded bushing for moving along the threaded rod for tuning the rotation angle of the antenna on the antenna carrier.

2. The carrier of claim 1 wherein the fixture has a fine tuning graduation and the extension arm of the mast clamp has a first pointer for pointing to a value of the rotation angle of the antenna on the fine tuning graduation.

3. The carrier of claim 1 wherein one end of the fine tune module is movably disposed on the extension arm of the mast clamp.

4. The carrier of claim 1 wherein the mast comprises a support seat and a bushing for connecting the support seat and the mast clamp.

5. The carrier of claim 4 wherein the bolt is used for fixing the fixture on one side of the support seat.

6. The carrier of claim 1 further comprising a bracket having a first end disposed on the first end of the mast clamp and a second end rotatably disposed on the mast clamp for adjusting an elevation angle of the antenna.

7. The carrier of claim 6 further comprising a rotational fixture rotatably disposed on the bracket for adjusting the rotation angle of the antenna.

8. The carrier of claim 7 further comprising a support arm having one end disposed on the rotational fixture and another end supporting a low noise signal amplifier for receiving radio signals from the antenna.

9. The carrier of claim 7 wherein the antenna is disposed on the rotational fixture.

10. The carrier of claim 1 wherein the extension arm is installed on the underside of the mast clamp.

11. The carrier of claim 1 wherein the bolt is a U-bolt.

12. A radio wave receiving device comprising:

an antenna device;

a carrier disposed with the antenna device;

a seat;

a connecting module connected to the carrier; and a rotation angle fine tune module connected to the seat and the connecting module for adjusting a rotation angle of the carrier and the antenna, the rotation angle fine tune module comprising a fixing unit and a fine tuning unit; the fixing unit being directly or indirectly disposed on the seat for fixing the fine tuning unit;

wherein the fine tuning unit comprises a studded bushing, a threaded bushing, a threaded rod, and a choke unit; the studded bushing is set on the connecting module; the threaded bushing is set on the fixing unit; the studded bushing comprises a first hole having an internal diameter larger than the diameter of the threaded rod and a threaded stud perpendicular to said first hole; the threaded bushing comprises a second hole matched to the thread of the threaded rod; the first end of the threaded rod is through the first hole, the choke unit is set on the threaded rod for limiting the range that the studded bushing can be moved along the length of the threaded rod; the second end of the threaded rod is through the second hole for moving the threaded bushing along the length of the threaded rod when the threaded rod is turned.

13. The radio wave receiving device of claim 12 wherein the connecting module further comprises a locking module for fixing the connecting module on the seat to prevent changes in the rotation angle of the antenna.

* * * * *